United States Patent [19]

Pierson et al.

[11] 4,330,574

[45] May 18, 1982

[54] FINISHING METHOD FOR CONVENTIONAL HOT DIP COATING OF A FERROUS BASE METAL STRIP WITH A MOLTEN COATING METAL

[75] Inventors: Marvin B. Pierson, Franklin; Charles Flinchum, Hamilton, both of Ohio

[73] Assignee: Armco Inc., Middletown, Ohio

[21] Appl. No.: 191,857

[22] Filed: Sep. 29, 1980

Related U.S. Application Data

[63] Continuation-in-part of Ser. No. 30,660, Apr. 16, 1979, abandoned.

[51] Int. Cl.[3] ..... B05D 3/02

[52] U.S. Cl. ..... 427/319; 427/320; 427/321; 427/349; 427/432; 427/433; 427/434.2

[58] Field of Search ..... 427/320, 321, 329, 432, 427/374.4, 433, 319, 434.5, 434.6, 434.2, 434.7, 434.4, 345, 349; 118/63, 65

[56] References Cited

U.S. PATENT DOCUMENTS

| | | | |
|---|---|---|---|
| Re. 29,726 | 8/1978 | Byrd et al. | 427/433 |
| 1,430,649 | 10/1922 | Herman | 427/433 |
| 2,110,893 | 3/1938 | Sendzimir | 427/229 |
| 2,197,622 | 4/1940 | Sendzimir | 427/320 |
| 2,824,020 | 2/1958 | Cook et al. | 427/320 |
| 2,824,021 | 2/1958 | Cook et al. | 427/433 |
| 2,894,850 | 7/1959 | Greene et al. | 427/433 |
| 2,914,423 | 11/1959 | Knapp | 427/320 |
| 3,320,085 | 5/1967 | Turner | 427/321 |
| 3,505,042 | 4/1970 | Sievert et al. | 427/433 |
| 3,505,043 | 4/1970 | Lee et al. | 427/433 |
| 3,632,411 | 1/1972 | Stark | 427/433 |
| 3,711,320 | 1/1973 | Byrd et al. | 427/329 |
| 3,782,909 | 1/1974 | Cleary et al. | 427/433 |
| 3,808,033 | 4/1974 | Mayhew | 427/433 |
| 3,932,683 | 1/1976 | Robins et al. | 427/433 |
| 4,082,868 | 4/1978 | Schnedler et al. | 427/329 |
| 4,107,357 | 8/1978 | Asakawa et al. | 427/432 |
| 4,114,563 | 9/1978 | Schnedler et al. | 118/63 |
| 4,123,291 | 10/1978 | Arnold et al. | 427/255.4 |
| 4,123,292 | 10/1978 | Gibson et al. | 427/255.4 |
| 4,140,552 | 2/1979 | Arnold et al. | 427/320 |
| 4,148,946 | 4/1979 | Byrd et al. | 427/321 |

FOREIGN PATENT DOCUMENTS

| | | |
|---|---|---|
| 55-62154 | 5/1980 | Japan . |
| 588281 | 5/1947 | United Kingdom . |

*Primary Examiner*—Norman Morgenstern
*Assistant Examiner*—S. L. Childs
*Attorney, Agent, or Firm*—Frost & Jacobs

[57] ABSTRACT

A finishing method and apparatus for conventional continuous hot-dip coating of the type wherein a ferrous base metal strip is caused to pass beneath the surface of a coating bath of molten coating metal and is thereafter subjected to jet finishing, the ferrous base metal strip having been appropriately pretreated so as to be at the proper coating temperature and so as to have its surfaces oxide-free when passing through the bath of molten coating metal. The method comprises the steps of providing an enclosure for the two-side coated strip as it exits the coating bath, locating a finishing jet nozzle to either side of the coated strip within the enclosure, jet finishing the coated strip with a non-oxidizing or inert gas. The apparatus comprises the above mentioned enclosure with the jet finishing nozzles located therein and an appropriate system to provide a non-oxidizing or inert atmosphere within the enclosure.

15 Claims, 7 Drawing Figures

FINISHING METHOD FOR CONVENTIONAL HOT DIP COATING OF A FERROUS BASE METAL STRIP WITH A MOLTEN COATING METAL

CROSS REFERENCE TO RELATED APPLICATION

This is a continuation-in-part of application Ser. No. 30,660, filed Apr. 16, 1979, now abandoned, in the name of the same inventors and titled FINISHING METHOD AND APPARATUS FOR CONVENTIONAL HOT DIP COATING OF A FERROUS BASE METAL STRIP WITH A MOLTEN COATING METAL.

TECHNICAL FIELD

The invention relates to a finishing method and apparatus for conventional continuous hot-dip coating of a ferrous base metal strip with a molten coating metal, and more particularly to a method and apparatus whereby the coated ferrous base metal strip, upon exiting the coating bath, is maintained in an essentially oxygen-free atmosphere until jet finished with a non-oxidizing or inert gas.

BACKGROUND ART

The method and the apparatus of the present invention are applicable to a hot-dip coating of a ferrous base metal strip with zinc, zinc alloys, aluminum, aluminum alloys, terne, lead and those coating metals or coating metal alloys which have oxide forming characteristics such that optimum finishing cannot be accomplished by conventional jet practice or by conventional exit rolls. While not intended to be so limited, for purposes of an exemplary showing the method of the present invention will be described as applied to galvanizing. The method can be practiced on various types of galvanizing lines. For example, the method of the present invention is applicable to fluxless, hot-dip metallic coating of ferrous base metal strip where it is necessary to subject the strip surfaces to a preliminary treatment which provides the strip with oxide free surfaces and preferably brings the strip to a temperature approximating that of the molten zinc or zinc alloy coating bath at the time the strip is caused to pass beneath the surface thereof. One of the principal types of anneal-in-line, fluxless, preliminary treatments is the so-called Sendzimir process or oxidation-reduction practice disclosed in U.S. Pat. Nos. 2,110,893 and 2,197,622. Another anneal-in-line, fluxless, preliminary treatment in common use is the so-called Selas process or high intensity direct fired furnace practice disclosed in U.S. Pat. No. 3,320,085.

In the Selas process the ferrous base metal strip is passed through a direct fired preheat furnace section. The strip is heated by direct combustion of fuel and air producing gaseous products of combustion containing at least about 3% combustibles in the form of carbon monoxide and hydrogen. The strip reaches a temperature of about 535° C. to about 760° C. while maintaining bright surfaces completely free of oxidation. The strip is then passed into a reducing section which is in sealed relation to the preheat section and which contains a hydrogen and nitrogen atmosphere, wherein it may be further heated by radiant tubes to from about 650° C. to about 925° C. and thereafter cooled approximately to the molten coated metal bath temperature. The strip is then led beneath the bath surface while surrounded by the protective atmosphere.

Other related pretreatment techniques are taught in U.S. Pat. No. Re 29, 726—U.S. Pat. Nos. 3,837,790—4,123,291—4,123,292 and 4,140,552. The above mentioned prior art patents constitute non-limiting examples of fluxless, continuous galvanizing processes to which the method of the present invention is applicable. When such conventional strip preparation techniques as are taught in the above mentioned prior art are used, it is necessary that the base metal strip be maintained in a protective atmosphere at least until it passes beneath the surface of the bath of molten zinc or zinc alloy.

Such a protective atmosphere is not a requirement when flux or chemical strip preparation techniques of the type taught in U.S. Pat. Nos. 2,824,020 and 2,824,021 are employed. Briefly, when such chemical strip preparation techniques are used, the ferrous base metal strip is caused to pass through a flux bath and through means to assure the proper thickness of the flux coating on the strip. The ferrous base metal strip is then conducted through a heating chamber wherein the strip is heated to evaporate the water in the flux solution. Thereafter, the ferrous base metal strip is further heated to raise it to that temperature approaching the maximum temperature of stability of the flux coating on the strip. The strip is then caused to pass beneath the surface of the bath of molten zinc or zinc alloy so as to be coated. The method of the present invention is equally applicable to galvanizing lines utilizing such flux or chemical pretreatment systems.

From the above it will be evident that the method of the present invention is not limited to the use of any particular pretreatment of the ferrous base metal strip in the galvanizing line and the terms "pretreatment" or "pretreated" (as used herein and in the claims with reference to the ferrous base metal strip) are to be interpreted broadly to include any of the conventional pretreatment systems exemplified by the above noted prior art. In general, these terms refer to any appropriate pretreatment technique, the result of which is such that, during the actual coating step wherein the ferrous base metal strip passes through the molten bath of zinc or zinc alloy, it will be at or will achieve the proper coating temperature and its surface will be oxide-free.

In conventional continuous hot dip galvanizing, it is usual to cause the two-side coated strip to exit the molten coating metal bath into the ambient atmosphere. The most widely used finishing and coating weight control technique is to direct the coated strip between jet knives or nozzles which cause a blast of air or steam to impinge upon both sides of the coated strip, returning excess coating metal to the bath. This finishing technique, however, has a number of definite drawbacks. Some of these drawbacks include coating ripples, oxide curtains and, bath surface oxide problems, including the necessity for top skimming. All of these defects are real, but are reasonably controllable by known methods.

U.S. Pat. Nos. 4,107,357 and 4,114,563 and German Pat. No. 2,656,524 are exemplary of patents teaching methods for coating one side only of a ferrous base metal strip. In the practice of these processes, the coated strip after contact with the coating bath is maintained in a protective, non-oxidizing atmosphere and is jet finished with nitrogen or non-oxidizing gas. However, the primary purpose of these steps is to prevent oxidation of that side of the ferrous base metal strip not coated or, if the uncoated side has an oxide film thereon, to prevent adherence of the coating metal to the oxide film. Nevertheless, U.S. Pat. No. 4,114,563 mentions in passing that the above noted defects are controlled or eliminated when finishing in a protective atmosphere.

A major problem area encountered with conventional jet finishing is that of coating control at the edges of the strip. One edge problem is that of zinc coating thickness over a narrow band immediately adjacent each edge of the coated strip. The coating thickness of these bands is greater than the coating thickness over the rest of the strip width. If this coating thickness differential is great enough, edge buildup or spooling will occur when the continuous strip is coiled under tension.

Edge berries (small balls of oxide) which are attached to the strip edge and are pulled through the jet blast constitute another troublesome problem. Furthermore, an edge defect commonly known as "feathered oxide" occurs during low speed jet finishing. Feathered oxide is characterized by discontinuous patches of heavy coating metal oxide which pull through the jet blast. They appear much like feathers which extend inwardly from the strip edges with the tips thereof pointing toward the center of the strip.

Many methods have been used by prior art workers to reduce build-up and oxide control problems at the strip edges. Tapered jet nozzle slot openings are commonly used where the slot opening of the jet finishing nozzle continuously increases in width from the center of the jet nozzle to its ends. Such a contoured jet finishing nozzle is taught in U.S. Pat. No. 4,137,347.

Other methods to control edge coating include curving the jet nozzles so that the nozzle is closer to the strip at the strip edges than at the strip center. Also, vanes or nozzle extensions have been used at the strip edges to bring the nozzle closer to the edges than to the center of the strip. Still other methods include the use of shutters and auxiliary jets, both internal and external to the main jet nozzles, to alter the jet wiping force at the strip edges as compared to the jet wiping force at the strip center.

All prior art methods fall short of producing optimum edge control with a minumum of operator attention, maximum coating metal economy, and proper edge control over a wide range of strip widths and line speeds.

Edge build up in a one-side coating process differs from that encountered in a conventional two-side coating process. This is true because, when jet finishing is employed, it is normally performed with a single jet nozzle, preferably with a back-up roll on the uncoated side of the strip. As a result, edge build-up is less severe, since the back-up roll serves as an extension of the strip edges.

Yet another major hot-dip zinc coating defect is commonly referred to as "spangle relief". Spangle relief has two aspects. One is the variation of surface profile (zinc thickness) across the zinc crystal from one boundary to the opposite boundary. The other is a depressed spangle boundary which surrounds each spangle or crystal. Spangle relief can be reduced by such methods as purposely causing part of the zinc coating to alloy with the ferrous base metal, or by antimony additions to the zinc bath. However, none of these methods is entirely satisfactory.

As a result, many methods have been developed to suppress spangle formation. That is, to minimize final spangle size to such an extent that the spangles are hardly visible to the naked eye. For example, U.S. Pat. Nos. 3,322,558; 3,379,557 and 3,756,844 teach spangle minimizing methods. Most methods involve spraying water or water solutions against the molten coating to quench the coating and create many nucleation sites. However, the results achieved by these spangle minimizing methods are not always consistent.

While spangle relief can be reduced or masked by temper (skin-pass) rolling such temper rolling causes these defects to become imprinted in the base metal. As a result of this non-uniform cold working of the base metal, the defects may reappear when critical surface items such as automotive body parts and appliance parts are stamped or formed. These defects may not be completely masked after the parts are painted.

Coating irregularity problems constituted a major reason why prior art workers have recently turned their attention to a one-side coated product (as exemplified by U.S. Pat. No. 4,082,868) wherein the uncoated side is the side to be painted on critical surface items made therefrom, even at the sacrifice of corrosion resistance on the non-galvanized side.

Yet another problem area encountered with conventional jet finishing involves coating weights and line speeds. The viscous interaction between the coating metal and the strip is proportional to strip speed. At slow speeds, the prior art was faced with the problem of ripple formation. To combat this, it was found that minimizing jet nozzle to strip distance and reducing the jet finishing pressure will minimize the prominence of coating ripples. However, low jet finishing pressure and close positioning of the jet finishing nozzles at the same time create an edge build-up problem. Prior art workers therefore have had to adjust the parameters to control edge build-up and ripples and this has necessitated higher line speeds. As an example, it has been common practice to use conventional jet finishing only with strip speeds above about 100 feet per minute (30 meters per minute) to produce commercial class coating weight (ASTM A525, G90). Edge build-up problems on G-90 coating commonly occur at speeds below about 150 feet per minute (45 meters per minute). Heavier coatings are even more difficult to control edge-to-edge uniformly.

Another essential practice in most prior art jet finishing operations is to position the jet nozzles virtually directly opposed, such that the jet streams are in direct interference beyond the edges of the strip. This interference results in extremely high and objectionable noise levels. Vertically offset jet nozzles cause a wrap-around effect with a bead of heavy coating metal along the edge on the side opposite the last nozzle operating on the strip. In addition to the noise problem and the need for precise adjustment of the jet nozzles by the operator, opposed operation can result in coating metal splatter being blown off of the strip edge by one nozzle and into the nozzle opening of the opposed nozzle.

Prior art workers have hitherto jet finished hot-dipped, two-side coated galvanized and aluminized strip with nitrogen. Such jet finishing, however, has been performed in an ambient atmosphere. In jet finishing, less nitrogen is required when nitrogen is used than air when air is used. However, the results achieved by such finishing are more nearly like those achieved in jet finishing with air in an ambient atmosphere than like the results achieved by the present method.

U.S. Pat. Nos. 3,505,042 and 3,505,043 teach hot dip coating of a ferrous metal with magnesium-zinc alloy and magnesium-aluminum-zinc alloy respectively. The first of these references utilized coating rolls for coating control and nitrogen gas solely for cooling after finishing between exit rolls. The second of these references does not disclose specific finishing means, but does enclose the coating apparatus in an atmosphere of 10% hydrogen with the balance nitrogen. The reference also mentions blowing nitrogen gas over the coated strip being withdrawn from the bath to rapidly cool the coating and to control coating weight, the nitrogen gas having a temperature below 100° F. (40° C.) and preferably about 50° F. (10° C.).

The present invention is based upon the discovery that if, in a conventional, continuous, hot-dip, two-side galvanizing process, the coating metal as it exits the coating bath is surrounded by an enclosure in which a substantially oxygen-free atmosphere is maintained and if within the enclosure the coated strip is jet finished with non-oxidizing or inert gas, the finishing problems encountered with conventional finishing methods are markedly reduced or eliminated. The finishing method of the present invention enables the practice of any of the above noted spangle minimizing techniques, greatly enhancing the results achieved and the uniformity of spangle minimization throughout the width of the strip. Furthermore, the markedly improved results are consistent.

The most significant aspect of the present invention, however, is the discovery that all coating control problems at the strip edges are completely eliminated with the substantial exclusion of oxygen from the finishing process. Minimum operating speeds are no longer limited by edge build-up problems, but rather only by the desired coating weight relative to the amount of coating metal naturally pulled up by the strip to the finishing jet nozzles. It has been found, for example, that excellent quality G-90 coatings can be produced without difficulty at speeds as low as 30 feet per minute (9 meters per minute).

Coating control at the strip edges is a very real problem in a two-side coating process where jet finishing cannot be accomplished against a back-up roll as in one-side coating processes. In the practice of the teachings of the present invention, heavy coating at the strip edges does not occur. Jet nozzles can be vertically offset, eliminating the need for precise positioning, greatly reducing noise, and eliminating the hazard of zinc splatter plugging opposed nozzles. Jet nozzle design may be simplified to utilize a slot-like nozzle opening of uniform width throughout its length, rendering unnecessary the multitude of special jet nozzle designs, methods and accessories which have been used for controlling edge build-up. Superior uniform coating thickness results edge-to-edge for all coating weights because the center profile need no longer be distorted to compensate for heavy edges. As a result, coils can be wound under high tension without spooling. Furthermore, with uniform coating weight edge-to-edge, less coating metal is used. The greatly reduced noise, by virtue of vertically offsetting the jet nozzles in an enclosure, represents a major step in safety and environment improvement. The simplified jet nozzle design results in more uniform coating, more uniform cooling and a flatter strip.

Heretofore, in the practice of conventional two-side jet finishing, neither the mechanism for ripple formation nor that causing edge build-up problems was completely understood. In the process of conventional jet finishing, a pneumatic dam effect is created whereby the desired amount of coating metal is metered through the jet barrier to form the finished coating. At this metering point the excess coating metal pulled up with the strip, beyond that required for the finished coating, is returned to the coating bath. This process is described in detail in U.S. Pat. No. 4,078,103.

While applicants do not wish to be bound by theory, it appears as a result of the present invention that the coating ripples and heavy edge coating in conventional jet finishing are caused entirely by coating metal oxide. At some point in the jet interaction region, probably just above the point of zero surface velocity , fresh (unoxidized) coating metal is being exposed and, as it is exposed, it immediately forms a very light oxide skin. The continuity of flow or distribution of this very light oxide skin onto the finished coating determines the occurrence of coating ripples. In conventional practice, the jet periodically restrains the oxide film. The film builds up until the jet no longer can restrain it. At this time a segment of relatively heavy oxide breaks off and passes with the finished coating. The segment as it passes carries with it coating beneath which is heavier than that which is metered on when the oxide film is restrained. This process is repeated many times each second as ripples are formed.

A similar mechanism is believed to be operable in creating heavy coating metal along the strip edges. However, at the edges, geometry becomes an additional important factor in that there is no wiping force directed against the edge surfaces. Relatively heavy oxide is permitted to pass through the jet interaction area more or less continuously carrying with it heavy coating beneath. This oxide envelope around each strip edge surface is the "container" which permits zinc wrap-around to occur when the jet nozzles are vertically offset.

Edge build-up of the molten coating metal is eliminated by the practice of the present invention by avoiding oxidation.

The zinc coated product produced by the method of the present invention (including spangle minimization) has such excellent surface qualities after temper rolling that it is suitable for use in exposed automotive body panels, appliance applications and the like.

DISCLOSURE OF THE INVENTION

The invention is directed to an improved finishing method and apparatus for conventional continuous hot-dip coating lines producing two-side coated product. As indicated above, for purposes of an exemplary showing the invention will be described in its application to a galvanizing line. The conventional continuous hot-dip galvanizing line may be of any appropriate and well known type utilizing any suitable pretreatment steps for the ferrous base metal strip to assure that the surfaces of the ferrous base metal strip achieve an oxide-free condition and a proper coating temperature prior to or during its travel through the bath of molten zinc or zinc alloy.

In accordance with the method of the present invention, the coated strip exiting the galvanizing bath is maintained in an enclosure and is subjected to jet finishing within the enclosure. The jet finishing is accomplished with an inert or non-oxidizing gas and the jet finishing gas and the atmosphere within the enclosure are maintained at an oxygen level below 1000 ppm. It is preferred that the oxygen level in both the enclosure atmosphere and the jet finishing gas be less than about 200 parts per million and, for optimum aresults, less than about 100 parts per million. The jet finishing may be achieved using any appropriate type of jet nozzles which may be staggered vertically with respect to each other, if desired. This invention allows the use of nozzles having a rectangular slot equidistant from the strip throughout its length. Steps are taken to prevent the entrance of ambient atmosphere into the enclosure particularly at the point where the coated strip exits the enclosure. When the coating metal is zinc or zinc alloy, the finishing step may be followed by a conventional spangle minimizing step conducted outside the enclosure.

The enclosure of the present invention is configured to maintain an inert or non-oxidizing atmosphere about the strip exiting the bath of molten coating metal. The enclosure houses the jet nozzles. The enclosure can be a separate structure or an integral part of the snout through which the strip enters the bath of molten coating metal. Various coating bath roll arrangements can be used, as will be described hereinafter.

DETAILED DESCRIPTION OF THE INVENTION

Figure 1:
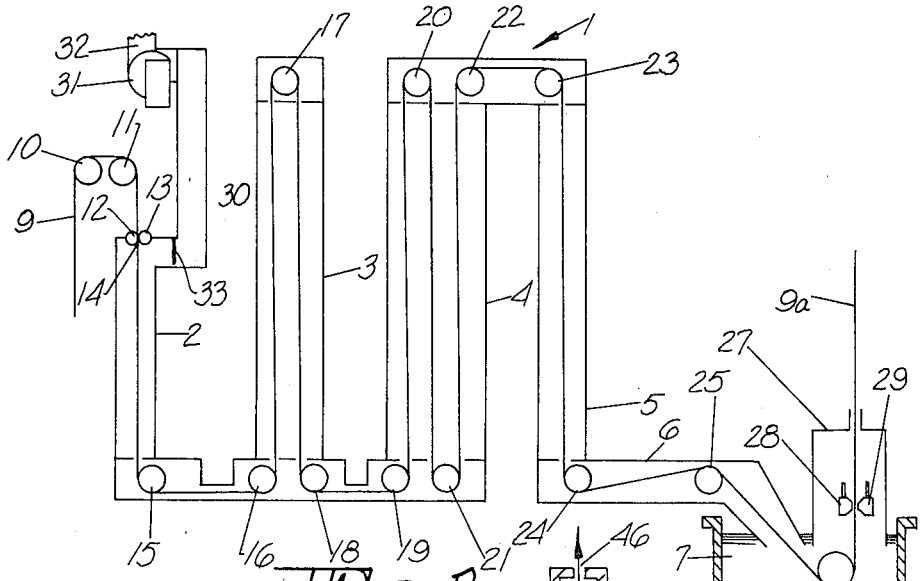
FIG. 1 is a fragmentary, semi-diagrammatic, cross sectional elevational view of an exemplary continuous hot-dip galvanizing line equipped to practice the method of the present invention.

While not intended to be so limited, for purposes of an exemplary showing the method of the present invention will be described as applied to a Selas-Type galvanizing line. Turning to FIG. 1, the coating line is generally indicated at 1. The strip preparation furnace of the coating line comprises a direct fired furnace 2, a controlled atmosphere heating furnace 3, a first cooling section 4, a second cooling section 5 and a snout 6. It will be noted that the snout 6 is configured to extend below the upper surface of a bath 7 of molten coating zinc or zinc alloy, located in a coating pot 8.

The ferrous base metal strip 9 to be prepared enters the direct fired furnace 2 over rolls 10 and 11 and through sealing rolls 12 and 13, so located as to minimize the escape of products of combustion through the entrance opening 14 of preheat furnace 2. The direct fired furnace 2 operates at a temperature on the order of 1260° C. (2300° F.). The function of the direct fired furnace is to quickly burn away oil and the like from the surfaces of the ferrous base metal strip 9, while providing partial heating for annealing the strip. The direct fired furnace, at the temperature indicated, will be sufficient to heat the entering strip to a temperature of from about 535° C. (1000° F.) to about 760° C. (1400° F.) by the time it passes from the direct fired furnace to the controlled atmosphere heating furnace 3.

The ferrous base metal strip 9 passes about turn-around rolls 15 and 16 and begins an upward travel through controlled atmosphere heating furnace 3. Thereafter, the strip passes about turn-around roll 17 and continues downwardly again through furnace 3. The controlled atmosphere heating furnace may be of the radiant tube type and will further raise the temperature of the ferrous base metal strip 9 to from about 650° C. (1250° F.) to about 925° C. (1700° F.), depending upon the nature of the ferrous base metal strip and the desired final characteristics of the base metal strip.

The strip preparation furnace of the coating line 1 may have one or more cooling chambers. For purposes of this exemplary showing, the strip preparation furnace is illustrated as having two cooling chambers 4 and 5. From the controlled atmosphere heating furnace 3 the strip 9 passes about turn-around rolls 18 and 19 and enters cooling chamber 4. Chamber 4 may be of the tube cooling type well known in the art. In the exemplary illustration the ferrous strip 9 makes three vertical flights through cooling chamber 4, passing about turn-around rolls 20 and 21. Thereafter, the ferrous base metal strip 9 passes about turn-around rolls 22 and 23 to enter the second cooling chamber 5 which may be of the jet cooling type, again well known in the art.

The temperature to which the ferrous base metal strip 9 is cooled will depend upon a number of factors. Since the molten coating metal 7 in coating pot 8 is zinc or zinc alloy, the ferrous base metal strip will preferably be cooled to approximately 450° C. (840° F.). In some instances, however, the strip itself may be used as an additional means to introduce heat into the molten coating metal bath 7. Under these circumstances the ferrous base metal strip 9 may be introduced into bath 7 at a temperature somewhat higher than the melting point of the zinc or zinc alloy therein. Where the strip is not relied upon as one of the heat sources for the bath 7, the strip may be introduced into the bath at a temperature slightly below that of the bath. In any event, the strip temperature should be sufficiently high as to prevent casting of the molten coating metal thereon. By the same token, the strip temperature must not be so high as to bring about excess coating metal-base metal alloying.

From the cooling chamber 5 the ferrous base metal strip 9 passes about turn-around roll 24 and enters the snout 6. It will be noted that the free end of snout 6 extends downwardly below the surface of the zinc or zinc alloy bath 7. The ferrous base metal strip passes about turn-down roll 25 and is directed downwardly into bath 7. Within the bath, the strip is guided by one or more coating pot rolls so as to exit in a substantially vertical flight. In the embodiment shown, a single coating pot roll 26 is illustrated. The two-side coated ferrous base metal strip **9*a* exits the molten coating metal bath 7 and enters an enclosure 17, the lower end of which extends into the molten coating metal bath 7 to form a seal therewith. Within enclosure 27, the two-sided coated ferrous base metal strip 9*a* is caused to pass between a pair of jet finishing nozzles 28 and 29**.

It will be noted from FIG. 1 that the upper end of the direct fired furnace 2 is connected by a conduit 30 to an exhaust fan 31. The outlet 32 of exhaust fan 31 may be connected directly to a stack or to waste gas heat reclamation means (not shown). The strip preparation furnace of coating line 1 is be operated above atmospheric pressure (to prevent the introduction therein of oxygen from the ambient atmosphere) by controlling the discharge rate of the products of combustion from the direct fired furnace 2. To this end, a damper 33 may be located in conduit 30. The parameters under which the strip preparation furnace of coating line 1 is run do not constitute a limitation on the present invention.

Figure 2:
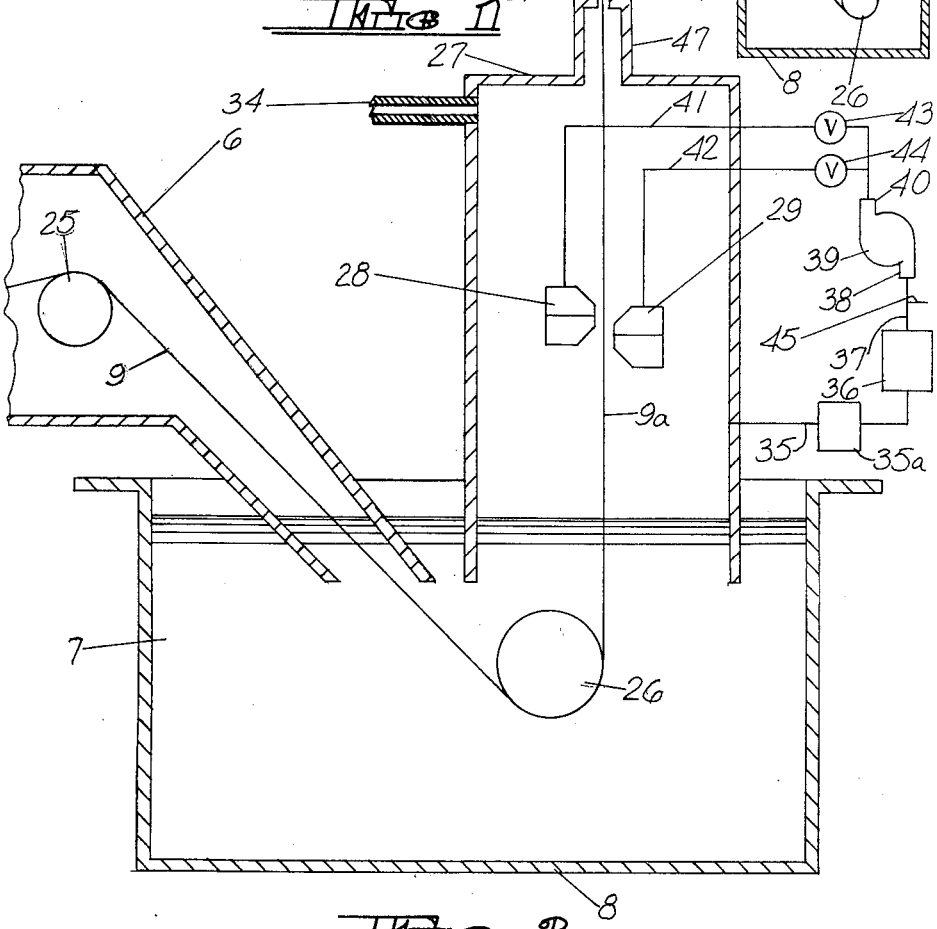
FIG. 2 is an enlarged, fragmentary, semi-diagrammatic, cross sectional view of the coating end of the galvanizing line of FIG. 1.

Reference is now made to FIG. 2 wherein the snout 5, coating pot 8 and enclosure 27 of FIG. 1 are shown enlarged. Like parts have been given like index numerals. In the embodiment of FIGS. 1 and 2, snout 6 and the enclosure 27 are illustrated as constituting wholly separate structures. It will be understood by one skilled in the art that the enclosure 27 could constitute an integral part of snout 6. When a chemical and flux pretreatment system is used, the snout 6 can be eliminated.

In accordance with the method of the present invention, a non-oxidizing atmosphere is maintained within enclosure 27. Any appropriate non-oxidizing or inert atmosphere may be used. A nitrogen atmosphere is preferred as being the most economical. The jet nozzles 28 and 29 can serve as the source of the atmosphere within enclosure 27, although additional atmosphere inlets such as the inlet 34 may be provided, if required.

A portion of the nitrogen atmosphere within enclosure 27 may be withdrawn and recirculated through the jet finishing nozzles 28 and 29. This is diagrammatically illustrated in FIG. 2. The enclosure 27 is provided with an outlet 35. The outlet 35 is preferably connected to a high temperature baghouse 35*a*, the atmosphere withdrawn from enclosure 27 passes to a heat exchanger 36. The heat exchanger 36 is connected as at 37 to the input 38 of a blower 39. The purpose of the heat exchanger is to cool the nitrogen from enclosure 27 ahead of blower 39 to prevent overheating of bearings and seals in the blower. The baghouse 35*a* could be located between heat exchanger 36 and blower 39, although it is preferred that it be ahead of exchanger 36 to prevent clogging of the heat exchanger fins with zinc or zinc oxide dust. The output 40 of blower 39 is connected by conduits 41 and 42 to jet finishing nozzles 28 and 29. The conduits or lines 41 and 42 may contain valves 43 and 44, respectively, so that the plenum pressure of the jet finishing nozzles 28 and 29 can be adjusted. It has been found that through the use of such baghouse-heat exchanger-blower-sealed conduit system, more than 50% of the high purity nitrogen requirement can be recirculated from enclosure 27 through jet finishing nozzles 28 and 29, thus reducing the nitrogen consumption. Make-up nitrogen may be introduced into the system via conduit 45 connected to the line 37 between heat exchanger 36 and the intake 38 of the blower 39. The atmosphere recirculation rate is so adjusted as to avoid infiltration of air through the slot 46 through which the coated strip 9*a* exits enclosure 27. Such a recirculating system can be used with any non-oxidizing or inert atmosphere.

The jet nozzles 28 and 29 are located to either side of the two side coated base metal strip 9*a* and directly opposite each other, as shown in FIG. 1. Edge problems including wrap-around have been eliminated by the present method, and it is preferred that the jet nozzles 28 and 29 be staggered vertically with respect to each other as shown in FIG. 2. This greatly reduces noise and prevents clogging of the nozzles due to zinc splatter and blow-off from one nozzle to the other, as explained above. Either jet knife can be located above the other. The higher of the two jet finishing nozzles (in this instance jet finishing nozzle 28) can be located up to about 2 feet (0.6 meters) or more above the bath. The jet finishing nozzles 28 and 29 may be vertically offset with respect to each other by any amount desired. Generally, they are offset from about ¼ inch (6 mm) to about 6 inches (150 mm). Usually the nozzles will be as close to the strip as possible within practical limits. For example, excellent results have been achieved with the nozzles spaced from the strip by a distance less than 1 inch (25 mm). When the jet finishing nozzles are offset, the noise level of the finishing step caused by the nozzles is greatly reduced. The jet nozzles 28 and 29 are preferably of simple construction, having a simple rectangular jet opening and being free of curved lips, shutters, vanes, or other devices. Excellent results have been achieved using jet finishing nozzles having a simple rectangular opening with a uniform width in the range of from about 0.05 to about 0.08 inch (1.3 to about 2 mm) throughout its length. Such jet nozzles have been found to provide very uniform cooling of the strip resulting in improved strip shape. This improved strip shape (flatness) allows the above noted close spacing of the jet nozzles to the strip, providing a greater flexibility in coating weight control while using less finishing gas. Such jet nozzles also provide a very uniform coating across the width of the strip, no longer requiring a heavy coating at the center of the strip to compensate for edge build-up.

The enclosure 27 is provided with an exit opening or slot 46 for the two-side coated ferrous base metal strip 9*a*. Care must be taken to assure that ambient air is not aspirated through the slot 46 due to high gas velocities and turbulent effects operating within the enclosure near the slot 46. Such turbulent effects may be intensified by recirculation. Ambient air aspirated through the slot 46 would cause excessive oxygen to be present in enclosure 27. The use of baffles or additional nitrogen purging around the strip exit 46 may assist in preventing such air aspiration. However, excellent results have been achieved by simply providing a short chimney 47 and locating exit slot 46 atop chimney 47.

The atmosphere within chamber 27 and the jet finishing gas are non-oxidizing or inert and, as indicated above, nitrogen is preferred for reasons of economy. For the very best results, the atmosphere within the chamber 27 and the jet finishing medium should have an oxygen content of less than about 100 ppm. Excellent results are achieved at an oxygen content of less than about 200 ppm. As the oxygen content of either the chamber atmosphere or the jet finishing medium increases above about 200 ppm, the benefits of the present invention diminish. While there is no absolute upper limit to the permissible oxygen content, and while at an oxygen content of about 1000 ppm some benefits over prior art practice are achieved, at an oxygen content above about 1000 ppm, the benefits achieved would probably not justify the practice of the present invention.

The enclosed finishing method of the present invention permits a short immersion, shallow coating pot practice utilizing a partially submerged coating pot roll. This is true because the method of the present invention minimizes the formation of oxide on the surface of the bath.

Figure 3:
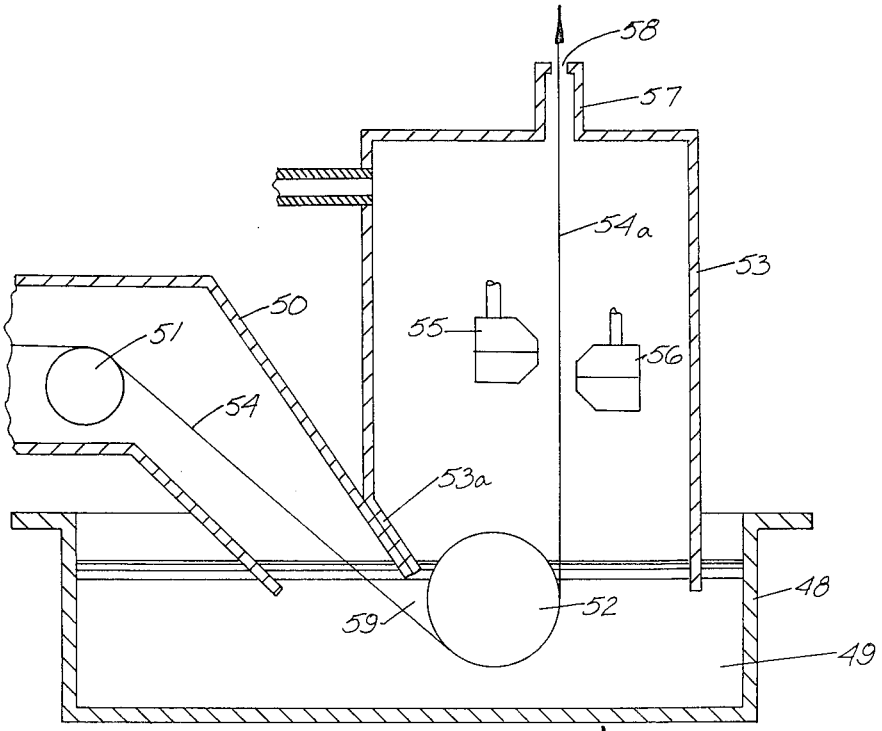
FIGS. 3, 4 and 5 are enlarged, fragmentary, semi-diagrammatic cross sectional views similar to FIG. 2, but illustrating various pot roll arrangements.

FIG. 3 illustrates such a short immersion, shallow coating pot practice. In FIG. 3 a coating pot is shown at 48. The coating pot 48 is similar to coating pot 8 of FIG. 2 with the exception that it is shallower. The coating pot 48 contains a bath of molten coating metal 49 which is of considerably less volume than the bath 7 of FIG. 2.

A snout 50, equivalent to snout 6 of FIG. 2, is shown with its lowermost end located beneath the surface of bath 49 so as to be sealed thereby. The snout 50 contains a turn-down roll 51 equivalent to turn-down roll 25 of FIG. 2. A pot roll is illustrated at 52. The pot roll 52 differs from pot roll 26 of FIG. 2 in that it is only partially submerged in the molten coating metal bath 49. The apparatus of FIG. 3 includes an enclosure 53 which is equivalent in every way to enclosure 27 of FIG. 2 with the exception that its lower rear edge 53*a* is bent slightly downwardly and inwardly so as to make a seal with the molten coating bath 49 while at the same time providing clearance for the flight of the uncoated ferrous base metal strip 54 between turn-down roll 51 and the pot roll 52. The coated ferrous base metal strip 54*a* is shown passing between a pair of jet finishing nozzles 55 and 56 and upwardly through a chimney 57 and an exit slot 58 equivalent to chimney 47 and exit slot 46 of FIG. 2.

The operation of the coating and finishing apparatus shown in FIG. 3 is substantially identical to that described with respect to FIG. 2. Again, jet finishing nozzles 55 and 56 may be connected to a recirculating system (not shown) of the type illustrated in FIG. 2. The primary difference between the operation illustrated in FIG. 3 and that illustrated in FIG. 2 lies in the fact that pot roll 52 is only partially submerged which provides the above noted advantages.

The amount by which pot roll 52 is submerged in bath 49 can be varied. In FIG. 3 pot roll 52 is shown more than half submerged. With appropriate configuration of snout 50 and the portion 53*a* of enclosure 53, the pot roll 52 could be less than half submerged, particularly in those instances where it is desirable to maintain the roll bearings (not shown) above the bath surface.

The pool of molten metal 59 between pot roll 52 and the ferrous base metal strip 54 engaging the pot roll must be of sufficient size to assure adequate coating of the back side or roll side of the ferrous base metal strip. It will be understood that the size of the pool 59 will decrease as the amount by which pot roll 52 is submerged decreases. It is within the scope of the present invention to augment this situation through the use of a grooved pot roll 52 or means to pump additional molten coating metal into the pool 59 (as will be described hereinafter).

Figure 4:
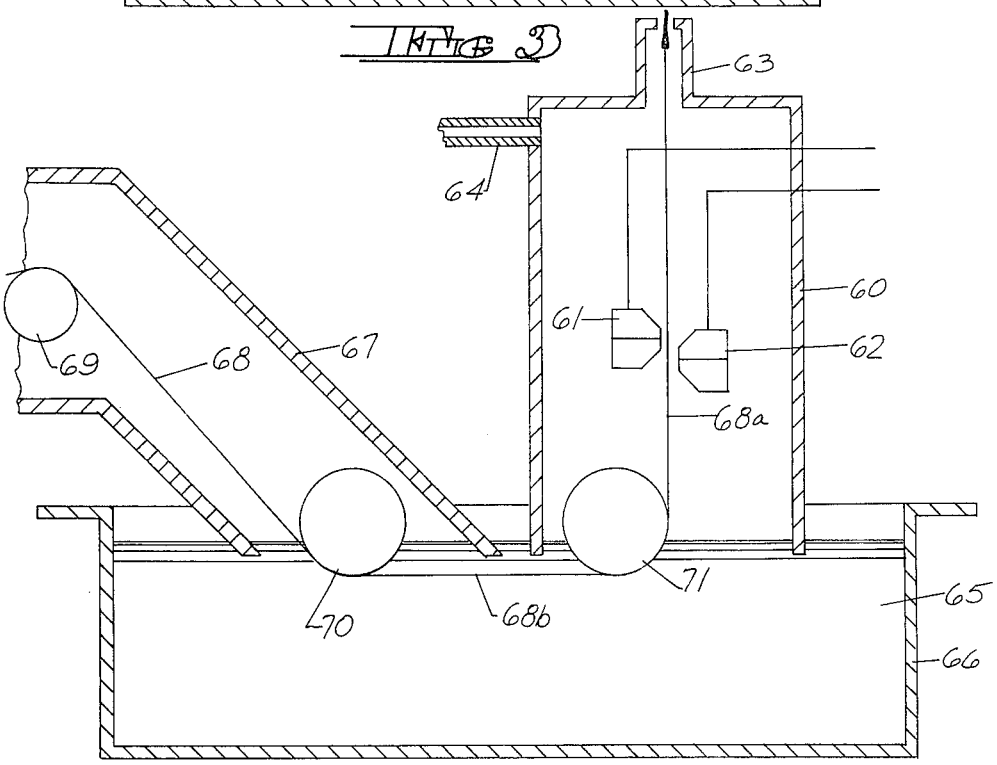

FIG. 4 illustrates another arrangement to assure adequate coating of the backside or roll side of the ferrous base metal strip in shallow pot practice. In FIG. 4 an enclosure is illustrated at 60 which may be identical to the enclosure 27 of FIG. 2, having a pair of jet finishing nozzles 61 and 62, an exit chimney 63 and an inlet 64 for the inert or non-oxidizing atmosphere. It will be understood that the enclosure 60 may be provided with the atmosphere recirculation system described with respect to FIG. 2. The lower end of enclosure 60 is submerged in bath 65 of molten coating metal located in a shallow pot 66. FIG. 4 also illustrates a conventional snout 67, similar to snout 6 of FIG. 2. Again it will be noted that the lowermost end of snout 67 extends below the surface of the molten coating metal bath 65.

The ferrous base metal strip to be coated is shown at 68. The strip passes about turn-down roll 69 in snout 67 and enters the bath as it passes about a first pot roll 70. From pot roll 70 it extends to a second pot roll 71 which directs the coated strip 68*a* upwardly through enclosure 60.

The amount by which pot rolls 70 and 71 extend into the molten coating bath 65 can be varied. For purposes of this exemplary showing, pot rolls 70 and 71 are illustrated as extending into the molten coating metal bath 65 by an amount less than 1/2 their diameters. The existence of the submerged strip 68*b* between pot rolls 70 and 71 assures adequate coating of the backside or roll side of the ferrous base metal strip. It has been determined that the shallow pot practice of the type just described with respect to FIGS. 3 and 4 does not significantly change the enclosed nitrogen finishing characteristics or advantages described with respect to FIGS. 1 and 2.

Figure 5:
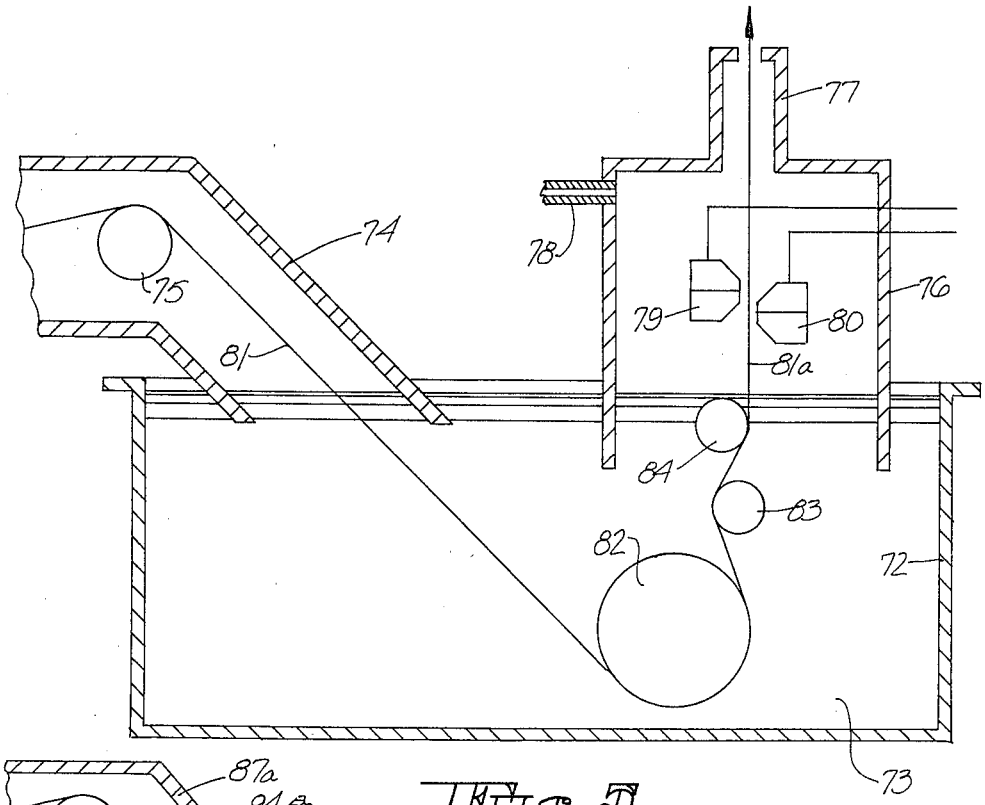

As has already been made evident, the apparatus of the present invention may utilize various pot roll arrangements. Another arrangement is illustrated in FIG. 5. In this Figure, a conventional coating pot is shown at 72 containing a molten coating metal bath 73. A snout 74, equivalent to snout 6 of FIG. 2 has its lower end submerged in the molten coating metal bath 73 and is provided with a turn-down roll 75, equivalent to turn down roll 25 of FIG. 2. An enclosure 76 has its lower end submerged in the molten coating metal bath 73. The enclosure 76 may be identical to enclosure 27 of FIG. 2, having an exit chimney 77 and an atmosphere inlet 78, if required. The enclosure contains a pair of jet finishing nozzles 79 and 80 equivalent to jet finishing nozzles 28 and 29 of FIG. 2. Again, the enclosure 76 may be provided with the atmosphere recirculating system (not shown) of FIG. 2.

In this embodiment, the ferrous base metal strip 81 to be coated enters the molten coating metal bath 73 and passes about a series of three pot rolls 82, 83 and 84. Rolls 83 and 84 are stabilizer rolls and provide strip shape control, assuring flatness of the coated strip 81*a* as it passes between jet finishing nozzles 79 and 80.

In all of the embodiments thus far described, the enclosure and the snout have been illustrated as separate structure. It is also within the scope of the present invention, however, to provide a snout and an enclosure which constitute an integral, one-piece structure. This is illustrated in FIG. 6.

Figure 6:
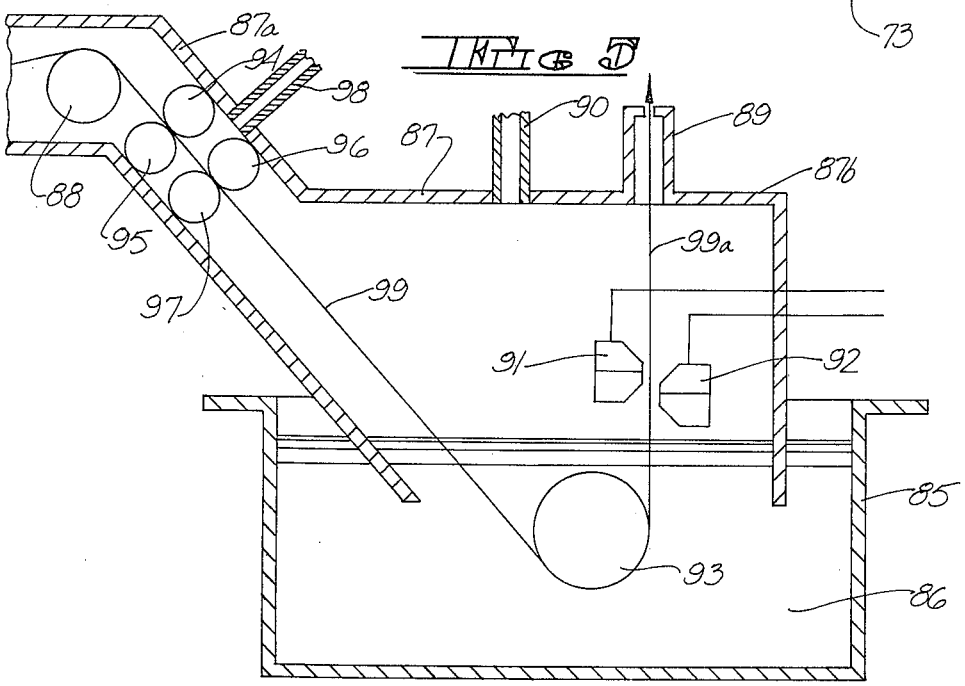
FIG. 6 is a fragmentary, semi-diagrammatic cross sectional view illustrating the enclosure of the present invention as constituting an integral part of the snout through which the strip enters the bath of molten coating metal.

In FIG. 6 a conventional coating pot 85 is shown containing a bath 86 of molten coating metal. The snout-enclosure structure is generally indicated at 87, having a snout portion 87*a* and an enclosure portion 87*b*. The snout portion 87*a* is similar to snout 6 of FIG. 2 and has a turn-down roll 88 located therein. Turn-down roll 88 is equivalent to turn-down roll 25 of FIG. 2. The enclosure portion 87*b* is similar to enclosure 27 and has an exit chimney 89. The enclosure portion 87*b* may be provided with an atmosphere inlet 90 equivalent to inlet 34 of FIG. 2. Jet knives 91 and 92 are located within the enclosure portion 87*b* and are in every way equivalent to jet knives 28 and 29 of FIG. 2. It will further be understood that the enclosure portion 87*b* may be provided with an atmosphere recirculating system (not shown) equivalent to that described with respect to FIG. 2. In the embodiment of FIG. 6, a submerged pot roll is shown at 93.

Under normal circumstances, the snout portion 87*a* and the enclosure portion 87*b* will contain different atmospheres and therefore some sort of seal means should be provided therebetween. The seal means may take any appropriate form. For purposes of an exemplary showing, the seal means is illustrated as being made up of two pairs of sealing rolls 94–95 and 96–97.

It is within the scope of the invention to provide an inlet 98 for an appropriate non-oxidizing gas between sealing rolls 94–95 and sealing rolls 96–97. It is preferable that the non-oxidizing atmosphere between sealing rolls 94–95 and sealing rolls 96–97 be at a pressure slightly higher than the pressure of the atmosphere in snout portion 87*a* and enclosure portion 87*b*. This assures that either the enclosure portion 87*b* or the strip preparation furnace associated with snout 87*a* can be shut down without contaminating the other. It will also prevent contamination of the atmosphere within hood portion 87*b* from sources at the entry end of the conventional strip preparation apparatus.

The strip 99 to be coated passes about turn-down roll 88 and between sealing roll pairs 94–95 and 96–97. The strip 99 enters the bath and passes about pot roll 93. Thereafter, the coated strip 99*a* passes upwardly between jet finishing nozzles 91 and 92, exiting through exit chimney 89. Thus, the operation of the apparatus and the advantages achieved thereby are essentially the same as has been described with respect to FIGS. 1 and 2.

Figure 7:
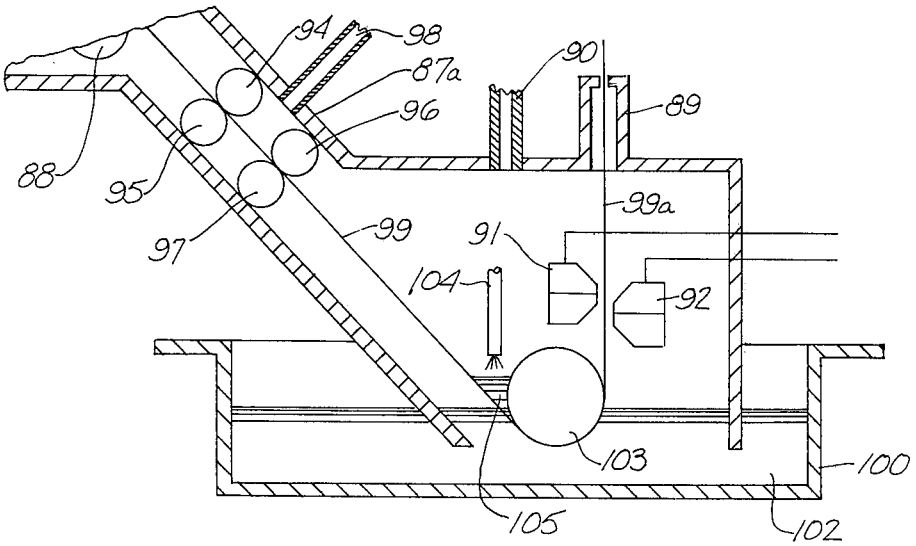
FIG. 7 is a fragmentary, semi-diagrammatic cross sectional view, similar to FIG. 6, but showing a partially submerged pot roll and the use of a pump for the molten coating metal.
Figure 1:
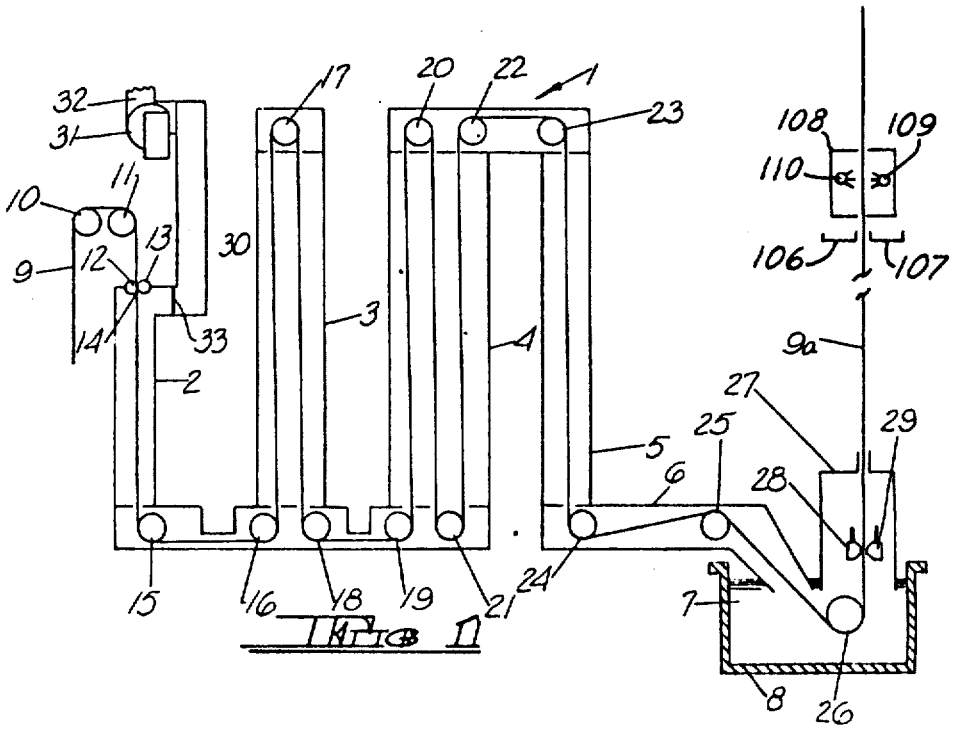

The unitary snout-enclosure of FIG. 6 can also be applied to shallow pot practice. This is illustrated in FIG. 7. In FIG. 7, the snout-enclosure apparatus is identical to that of FIG. 6 and like parts have been given like index numerals. In the embodiment of FIG. 7, a shallow pot is shown at 100, containing a shallow bath 102 of molten coating metal. In this instance, a pot roll 103 is shown being partially submerged in the molten metal coating bath 102. For purposes of this exemplary showing, the pot roll is illustrated as being submerged by an amount less than half its diameter. The pot roll 103 could, of course, be submerged by an amount more than half its diameter, as is shown with respect to pot roll 52 of FIG. 3. It would even be possible to provide the apparatus of FIG. 7 with a pair of pot rolls of the type described with respect to FIG. 4.

In FIG. 7, however, for purposes of an exemplary showing the apparatus is illustrated as being provided with a pump for the molten coating metal of bath 102, the outlet of the pump being shown at 104. The pump outlet 104 creates a pool 105 of molten coating metal between the ferrous base metal strip 99 and pot roll 103, which pool assures adequate coating of the back or roll side of the ferrous base metal strip. Such a pump for the molten coating metal could be provided for the embodiment of FIG. 3, if the pool 59 of FIG. 3 were inadequate. In all embodiments of the present invention, where the pot roll is only partially submerged, it would be within the scope of the invention to use a grooved pot roll. The grooves carry molten coating metal to the roll side of the ferrous base metal strip.

With the method of the present invention, it has been found that relatively heavy coatings can be achieved at lower line speeds with excellent surface characteristics. For example, with minimum controlled wipe by the jet finishing nozzles, coating weights of up to about 543 g/m$^2$ (about 1.78 ounces per square foot) have been achieved at a line speed of 40 feet per minute (12 meters per minute) in the laboratory.

A laboratory test found that the finishing method of the present invention produced a coated strip with extremely flat spangle. The spangle boundary relief was so slight that it was not necessary to practice spangle minimizing techniques to achieve excellent surface quality. In commercial, in-plant runs, it was found preferable to practice a spangle minimizing step, the results of which produced an excellent surface suitable for the application of paint for automotive and appliance uses. The results of the minimizing step were not only excellent, but also were consistent, and required less operator adjustment of the minimizing equipment than previously experienced when finishing with air.

Any of the above mentioned minimizing processes can be used. While not intended to be limiting, a preferred minimizing procedure is taught in the above mentioned U.S. Pat. No. 3,379,557, the teachings of which are incorporated herein by reference. Briefly, a water solution of an inorganic salt is mixed with steam and sprayed against the freshly coated strip at a point just below that position where normal coating solidification would occur. The inorganic salt is selected from the class consisting of inorganic salts which decompose in the range of 175° F. to 550° F. (80° C. to 90° C.) and those salts which will hydrolize when added to water to form inorganic salts capable of decomposing in the above stated temperature range. The water solution is applied to the coated strip in a band extending transversely of the direction of strip travel, the band having such a width that the coating metal is molten as it enters the the band and solid as it leaves the band. The inorganic salt solution of the type described provides a multitude of solidification nuclei to the coating when the coating is at a temperature very close to the solidification point (or freezing point) of the coating metal. This results in inducing a multitude of closely spaced, relatively minute, spangles which are sub-microscopic, or so nearly so as to be just barely visible to the naked eye.

This procedure is diagrammatically illustrated in FIG. 1. The two-side coated ferrous base metal strip 9*a* exits chamber 27 and is caused to pass between a pair of tray-like structures 106 and 107 and through an enclosure 108 containing spray nozzles 109 and 110 for the minimizing inorganic salt solution. Trays 106 and 107 serve to catch the majority of the overspray condensate. It will be understood that this or another appropriate minimizing process can be practiced with all of the embodiments of the present invention illustrated in FIGS. 2 through 7.

The consistently excellent surface achieved in the plant runs is a direct result of the finishing method of the present invention. This is true because the finishing method of the present invention provides a more uniform coating across the width of the ferrous base metal strip; a more uniform cooling of the coated strip edge-to-edge results in a more uniform thermal profile; and less surface oxide to interfere with nucleation. The more uniform cooling and reduced amount of surface oxide produced by the finishing method of the present invention gives more latitude to the placement of the minimizing nozzles 109 and 110 and reduces the amount of spray required. With less spray there is less hazard of coating damage from pitting. A smaller, more uniform spangle size is consistently achieved across the strip width. In instances where spangle is of no concern or is desired, and in instances where a coating metal other than zinc or zinc alloy is used, a minimizing step need not be practiced.

The present invention has been practiced with aluminum as the coating metal and a smoother coating with no edge build-up was produced.

EXAMPLE 1

A laboratory galvanizing line utilizing a 4 inch (100 mm) strip was provided with an enclosure similar to enclosure 27 of FIG. 2. The chimney 47 was six inches (150 mm) high and was provided with an exit slot 46 having a width of one and one quarter inches (30 mm) and a length of five inches (130 mm). The enclosure was provided with a pair of jet finishing nozzles having a slot-like opening of 0.050 inch (1.3 mm) width throughout its length. The lower of the two jet finishing nozzles was maintained at a distance of four inches (100 mm) from the bath surface. The other jet nozzle was offset vertically and upwardly therefrom by one half inch (13 mm). The jet nozzles were maintained at a distance from the strip of about one quarter inch (6 mm). The enclosure was provided with a recirculating system of the type shown in FIG. 2. Make up nitrogen was added at the rate of 3,000 cubic feet per hour (84 cubic meters per hour) and the nitrogen atmosphere within the enclosure was maintained at a pressure of 0.5 inches (13 mm) of water.

The cold rolled ferrous base metal strip gage was 0.015 inches (0.4 mm) with relatively smooth surfaces at 50 inches (1.3 meters) and 90 peaks per inch (3500 peaks per meter). During this run, a G-60 coating was being produced and a line speed of 70 feet per minute (21 meters per minute) was used. The influence of oxygen contamination in the enclosure containing high purity nitrogen was evaluated by metering compressed air into the recirculating system in increasing amounts until defects were observed in the molten coating. With oxygen below 50 ppm the molten coating was glassy smooth, free of visible oxide and without sign of edge problems. The solidified coating showed a dead flat spangle without spangle boundary relief. As the oxygen was purposely increased, no change occurred at an oxygen level of 140 ppm. Detrimental finishing effects were first observed at an oxygen level within the enclosure of about 200 ppm in the form of edge oxide berries, ripples, a ridge of heavy edge metal, and some spangle relief. These conditions become steadily more pronounced as the oxygen level was increased to 600 ppm. Surface oxide bands developed when the oxygen level reached about 700 ppm. These oxide bands extended inwardly from the strip edge and increased to feathers of oxide when the oxygen level reached 850 ppm.

This run showed that the enclosed nitrogen finishing method of the present invention produces a smooth, uniform hot-dip zinc coating finish without the common ripple, dross, oxide curtain and edge build-up defects associated with conventional edge finishing. Simplified jet finishing nozzles with uniform slot openings can be used and can be vertically offset without zinc splatter and without heavy edge coating or coating wrap-around. The noise level of the finishing step was drastically reduced by virtue of the fact that the nozzles were offset with respect to each other. The relationship between oxygen contamination of the finishing gas and the coating surface quality was clearly demonstrated. The above noted comments regarding the effects of oxygen contamination of the finishing gas, demonstrated by this experimental laboratory run, are made comparing the coated metal at various oxygen levels at and above about 200 ppm. Excellent results are achieved when the oxygen level within the enclosure is maintained below about 200 ppm and preferably below about 100 ppm. As the oxygen level increases from about 200 ppm to about 1000 ppm detrimental effects such as oxide berries, edge build-up and spangle relief increase. Even within this range, however, the coating quality is superior to that achieved by the prior art practice of finishing in air.

In other similar runs nitrogen at the rate of 3000 cubic feet (84 cubic meters) per hour was circulated through the jet finishing nozzles using about 1500 cubic feet (42 cubic meters) per hour or less make-up nitrogen, confirming the ability to recirculate more than 50% of the high purity finishing gas requirement.

EXAMPLE 2

An in-plant, commercial line was provided with an enclosure similar to enclosure 27 of FIG. 2. A G60 zinc coating was applied to a 0.031 inch (0.8 mm) ferrous base metal strip having a width of 60 inches (1.5 meters) and a line speed of 240 feet (73 meters) per minute. The enclosure was provided with a pair of jet finishing nozzles, each having a slot-like opening 0.070 inch (1.8 mm) wide and 84 inches (2 meters) long. The front nozzle was positioned 14 inches (0.35 meters) above the bath surface and the back nozzle was located 13¾ inches (0.34 meters) above the bath surface. Both nozzles were oriented normal to the strip and spaced therefrom by ½ inch (13 mm). A nitrogen flow of 50,000 cubic feet (1375 cubic meters) per hour was maintained in each nozzle with no nitrogen recirculation. An oxygen content of 73 ppm was maintained in the enclosure. The coated and finished strip was subjected to a spangle minimizing step in accordance with the above mentioned U.S. Pat. No. 3,379,557.

EXAMPLE 3

Another in-plant run was made on the same commercial line used in Example 2. A G60 zinc coating was applied to a 0.053 inch (1.4 meters) ferrous base metal strip having a width of 55 inches (1.4 meters) and traveling at a speed of 200 feet (60 meters) per minute. The remaining steps and parameters wer the same as in Example 2 with the exception that the jet finishing nozzles were both spaced ¾ inch (20 mm) from the strip and each has a nitrogen flow therethrough of 40,000 cubic feet (1000 cubic meters) per hour. The oxygen content within the enclosure was maintained at 80 ppm. The spangle minimizing step was performed.

The material of Example 2 had a coating weight of 0.32 ounces per square foot (98 grams per square meter) on its front side and a coating weight of 0.33 ounces per square foot (101 grams per square meter) on its back side. The material of Example 3 had front and back coating weights of 0.33 and 0.31 ounces per square foot (101 and 95 grams per square meter), respectively. The materials of both Example 2 and Example 3 were characterized by excellent coatings which were smooth, uniform, and free of oxide defects and edge build-up. Superior and consistent spangle minimization was achieved, rendering the coated materials suitable for critical surface uses.

Laboratory runs have been made using aluminum as the coating metal. Again, smooth, uniform coatings free of edge build-up and oxide defects were achieved. This is true despite the fact that, in general, aluminum coatings are more subject to dross and ripple defects than zinc coatings.

In all of the embodiments illustrated in the Figures, the enclosure is shown in semi-diagrammatic fashion. It will be understood by one skilled in the art that the enclosure will be provided with suitable support means and the like. Furthermore, the enclosure may be removable in whole or in part for maintenance or if regular air finishing is to be practiced.

The products of the present invention can be subjected to any appropriate and well known past treatments such as special treatments for better paint adherence and the like.

Modification may be made in the invention without departing from the spirit of it.

What is claimed is:

1. A finishing process for conventional continuous hot-dip, two-side coating of a ferrous base metal strip with a molten coating metal of the type wherein said ferrous base metal strip is caused to enter a bath of said molten coating metal contained in a coating pot, said ferrous base metal strip having been treated to bring it to a coating temperature sufficiently high to prevent casting of said coating metal thereon and low enough to prevent excess coating metal-base metal alloying and to render the surfaces of said strip clean and free of oxide as it passes through said molten coating metal bath, said finishing process comprising the steps of providing an enclosure in sealed relationship with said bath for said two-side coated ferrous base metal strip as it exits said bath and an exit in said enclosure for said coated strip, maintaining a non-oxidizing atmosphere within said enclosure, locating a jet finishing nozzle to either side of said coated strip within said enclosure, jet finishing said coated strip with a non-oxidizing gas and maintaining said jet finishing gas and said atmosphere within said enclosure at an oxygen level of less than about 1000 ppm, whereby to render said two-side coated strip uniform in appearance and coating thickness.

2. The process claimed in claim 1 wherein said molten coating metal is chosen from the class consisting of zinc, zinc alloys, aluminum, aluminum alloys, terne and lead.

3. The process claimed in claim 1 including the step of maintaining said jet finishing gas and said atmosphere within said enclosure at an oxygen level of less than about 200 ppm.

4. The process claimed in claim 1 including the step of maintaining said jet finishing gas and said atmosphere within said enclosure at an oxygen level of less than about 100 ppm.

5. The process claimed in claim 1 wherein said non-oxidizing jet finishing gas and said atmosphere within said enclosure comprise nitrogen.

6. The process claimed in claim 1 wherein said non-oxidizing jet finishing gas and said atmosphere within said enclosure comprise an inert gas.

7. The process claimed in claim 1 including the step of vertically staggering said jet finishing nozzle with respect to each other.

8. The process claimed in claim 1 wherein each of said jet finishing nozzles has a rectangular nozzle opening of uniform width throughout its length and equidistant from said coated strip throughout its length.

9. The process claimed in claim 1 including the step of recirculating a portion of said non-oxidizing gas from said enclosure through said jet finishing nozzles.

10. The process claimed in claim 1 wherein said molten coating metal is chosen from the class consisting of zinc and zinc alloys and including the step subjecting said two-side coated strip to a spangle minimizing treatment after said strip exits said enclosure.

11. The process claimed in claim 5 including the step of recirculating a portion of said nitrogen from said enclosure through said jet finishing nozzles.

12. The process claimed in claim 5 including the step of vertically staggering said jet finishing nozzles with respect to each other.

13. The process claimed in claim 12 wherein each of said jet finishing nozzles has a rectangular nozzle opening of uniform width throughout its length and equidistant from said coated strip throughout its length.

14. The process claimed in claim 13 including the step of maintaining said nitrogen at an oxygen level of less than about 100 ppm.

15. The process claimed in claim 14 including the step of subjecting said two-side coated strip to a spangle minimizing treatment after said strip exits said enclosure.

* * * * *

UNITED STATES PATENT AND TRADEMARK OFFICE

CERTIFICATE OF CORRECTION

PATENT NO. : 4,330,574

DATED : May 18, 1982

INVENTOR(S) : Marvin B. Pierson, et al

It is certified that error appears in the above-identified patent and that said Letters Patent is hereby corrected as shown below:

The title page showing the illustrative figure should appear as per attached sheet.

Figure 1 should appear as per attached sheet.

Signed and Sealed this

*Second* Day of *November 1982*

[SEAL]

*Attest:*

GERALD J. MOSSINGHOFF

*Attesting Officer* *Commissioner of Patents and Trademarks*

United States Patent [19]

Pierson et al.

[11]

[45] May 18, 1982

[54] FINISHING METHOD FOR CONVENTIONAL HOT DIP COATING OF A FERROUS BASE METAL STRIP WITH A MOLTEN COATING METAL

[75] Inventors: Marvin B. Pierson, Franklin; Charles Flinchum, Hamilton, both of Ohio

[73] Assignee: Armco Inc., Middletown, Ohio

[21] Appl. No.: 191,857

[22] Filed: Sep. 29, 1980

Related U.S. Application Data

[63] Continuation-in-part of Ser. No. 30,660, Apr. 16, 1979, abandoned.

[51] Int. Cl.[3] ..... B05D 3/02

[52] U.S. Cl. ..... 427/319; 427/320; 427/321; 427/349; 427/432; 427/433; 427/434.2

[58] Field of Search ..... 427/320, 321, 329, 432, 427/374.4, 433, 319, 434.5, 434.6, 434.2, 434.7, 434.4, 345, 349; 118/63, 65

[56] References Cited

U.S. PATENT DOCUMENTS

| | | | |
|---|---|---|---|
| Re. 29,726 | 8/1978 | Byrd et al. | 427/433 |
| 1,430,649 | 10/1922 | Herman | 427/433 |
| 2,110,893 | 3/1938 | Sendzimir | 427/229 |
| 2,197,622 | 4/1940 | Sendzimir | 427/320 |
| 2,824,020 | 2/1958 | Cook et al. | 427/320 |
| 2,824,021 | 2/1958 | Cook et al. | 427/433 |
| 2,894,850 | 7/1959 | Greene et al. | 427/433 |
| 2,914,423 | 11/1959 | Knapp | 427/320 |
| 3,320,085 | 5/1967 | Turner | 427/321 |
| 3,505,042 | 4/1970 | Sievert et al. | 427/433 |
| 3,505,043 | 4/1970 | Lee et al. | 427/433 |
| 3,632,411 | 1/1972 | Stark | 427/433 |
| 3,711,320 | 1/1973 | Byrd et al. | 427/329 |
| 3,782,909 | 1/1974 | Cleary et al. | 427/433 |
| 3,808,033 | 4/1974 | Mayhew | 427/433 |
| 3,932,683 | 1/1976 | Robins et al. | 427/433 |
| 4,082,868 | 4/1978 | Schnedler et al. | 427/329 |
| 4,107,357 | 8/1978 | Asakawa et al. | 427/432 |
| 4,114,563 | 9/1978 | Schnedler et al. | 118/63 |
| 4,123,291 | 10/1978 | Arnold et al. | 427/255.4 |
| 4,123,292 | 10/1978 | Gibson et al. | 427/255.4 |
| 4,140,552 | 2/1979 | Arnold et al. | 427/320 |
| 4,148,946 | 4/1979 | Byrd et al. | 427/321 |

FOREIGN PATENT DOCUMENTS

| | | |
|---|---|---|
| 55-62154 | 5/1980 | Japan . |
| 588281 | 5/1947 | United Kingdom . |

*Primary Examiner*—Norman Morgenstern
*Assistant Examiner*—S. L. Childs
*Attorney, Agent, or Firm*—Frost & Jacobs

[57] ABSTRACT

A finishing method and apparatus for conventional continuous hot-dip coating of the type wherein a ferrous base metal strip is caused to pass beneath the surface of a coating bath of molten coating metal and is thereafter subjected to jet finishing, the ferrous base metal strip having been appropriately pretreated so as to be at the proper coating temperature and so as to have its surfaces oxide-free when passing through the bath of molten coating metal. The method comprises the steps of providing an enclosure for the two-side coated strip as it exits the coating bath, locating a finishing jet nozzle to either side of the coated strip within the enclosure, jet finishing the coated strip with a non-oxidizing or inert gas. The apparatus comprises the above mentioned enclosure with the jet finishing nozzles located therein and an appropriate system to provide a non-oxidizing or inert atmosphere within the enclosure.

15 Claims, 7 Drawing Figures

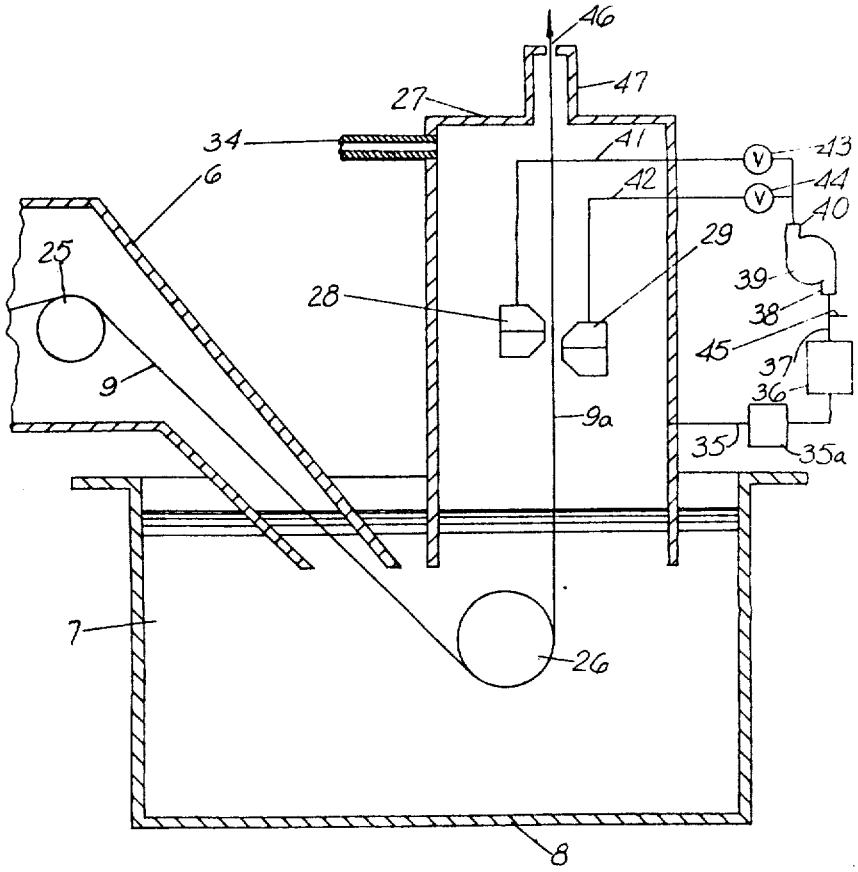

REEXAMINATION CERTIFICATE (861st)

United States Patent [19]

Pierson et al.

[11] B1 4,330,574

[45] Certificate Issued May 31, 1988

[54] FINISHING METHOD FOR CONVENTIONAL HOT DIP COATING OF A FERROUS BASE METAL STRIP WITH A MOLTEN COATING METAL

[75] Inventors: Marvin B. Pierson, Franklin; Charles Flinchum, Hamilton, both of Ohio

[73] Assignee: Armco Inc., Middletown, Ohio

Reexamination Request:
No. 90/001,287, Jul. 15, 1987

Reexamination Certificate for:

| | |
|---|---|
| Patent No.: | **4,330,574** |
| Issued: | **May 18, 1982** |
| Appl. No.: | **191,857** |
| Filed: | **Sep. 29, 1980** |

Certificate of Correction issued Nov. 2, 1982.

Related U.S. Application Data

[63] Continuation-in-part of Ser. No. 30,660, Apr. 16, 1979, abandoned.

[51] Int. Cl.[4] ..... B05D 3/02

[52] U.S. Cl. ..... 427/319; 427/320; 427/321; 427/349; 427/432; 427/433; 427/434.2

[56] References Cited

U.S. PATENT DOCUMENTS

| | | | |
|---|---|---|---|
| 2,332,978 | 10/1943 | Ahern | 427/432 |
| 3,808,033 | 4/1974 | Mayhew | 427/433 |
| 3,932,683 | 1/1976 | Robins et al. | 427/433 |

FOREIGN PATENT DOCUMENTS

| | | |
|---|---|---|
| 51-114334 | 10/1976 | Japan . |
| 54-65138 | 5/1979 | Japan . |
| 55-110767 | 8/1980 | Japan . |
| 55-110770 | 8/1980 | Japan . |

*Primary Examiner*—S. L. Childs

[57] ABSTRACT

A finishing method and apparatus for conventional continuous hot-dip coating of the type wherein a ferrous base metal strip is caused to pass beneath the surface of a coating bath of molten coating metal and is thereafter subjected to jet finishing, the ferrous base metal strip having been appropriately pretreated so as to be at the proper coating temperature and so as to have its surfaces oxide-free when passing through the bath of molten coating metal. The method comprises the steps of providing an enclosure for the two-side coated strip as it exits the coating bath, locating a finishing jet nozzle to either side of the coated strip within the enclosure, jet finishing the coated strip with a non-oxidizing or inert gas. The apparatus comprises the above mentioned enclosure with the jet finishing nozzles located therein and an appropriate system to provide a non-oxidizing or inert atmosphere within the enclosure.

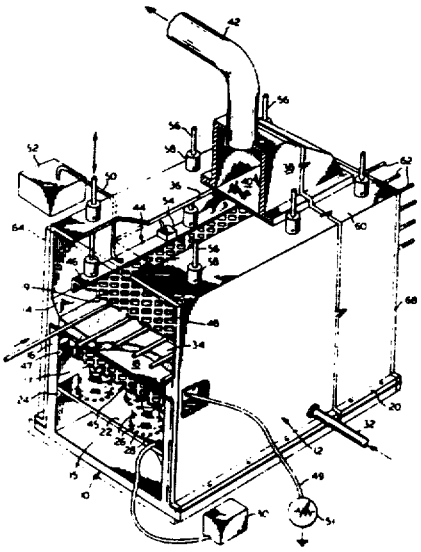

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claim 1 is determined to be patentable as amended.

Claims 2 and 4–15, dependent on an amended claim, are determined to be patentable.

New claims 16 and 17 are added and determined to be patentable.

1. A finishing process for conventional continuous hot-dip, two-side coating of a ferrous base metal strip with a molten coating metal of the type wherein said ferrous base metal strip is caused to enter a bath of said molten coating metal contained in a coating pot, said ferrous base metal strip having been treated to bring it to a coating temperature sufficiently high to prevent casting of said coating metal thereon and low enough to prevent excess coating metal-base metal alloying and to render the surfaces of said strip clean and free of oxide as it passes through said molten coating metal bath, said finishing process comprising the steps of providing an enclosure in sealed relationship with said bath for said two-side coated ferrous base metal strip as it exits said bath and an exit in said enclosure for said coated strip, maintaining a non-oxidizing atmosphere within said enclosure, locating a jet finishing nozzle to either side of said coated strip within said enclosure, jet finishing said coated strip with a non-oxidizing gas and maintaining said jet finishing gas and said atmosphere within said enclosure at an oxygen level of less than about [1000] *200* ppm, whereby to render said two-sided coated strip uniform in appearance and coating thickness.

*16. A finishing process for conventional continuous hot-dip, two-side coating of a ferrous base metal strip with commercial class coating weight of molten coating metal of the type wherein said ferrous base metal strip is caused to enter a bath of said molten coating metal contained in a coating pot, and said strip is passed through said bath at a speed below about 150 feet per minute, said ferrous base metal strip having been treated to bring it to a coating temperature sufficiently high to prevent casting of said coating metal thereon and low enough to prevent excess coating metal-base metal alloying and to render the surfaces of said strip clean and free of oxide as it passes through said molten coating metal bath, said finishing process comprising the steps of providing an enclosure in sealed relationship with said bath for said two-sided coated ferrous base metal strip as it exits said strip and an exit in said enclosure for said coated strip, maintaining a non-oxidizing atmosphere within said enclosure, locating a jet finishing nozzle to either side of said coated strip within said enclosure, jet finishing said coated strip with a non-oxidizing gas and maintaining said jet finishing gas and said atmosphere within said enclosure at an oxygen level of less than about 1000 ppm, whereby to render said two-side coated strip uniform in appearance and coating thickness.*

*17. The process claimed in claim 16, including the step of vertically staggering said jet finishing nozzles with respect to each other.*

* * * * *